US007008741B2

(12) United States Patent
Yu et al.

(10) Patent No.: US 7,008,741 B2
(45) Date of Patent: Mar. 7, 2006

(54) IMAGING MEMBERS

(75) Inventors: Robert C. U. Yu, Webster, NY (US); Satchidanand Mishra, Webster, NY (US); Anthony M. Horgan, Pittsford, NY (US); Richard L. Post, Penfield, NY (US); Yuhua Tong, Webster, NY (US); Edward F. Grabowski, Webster, NY (US); Kathleen M. Carmichael, Williamson, NY (US); Markus R. Silvestri, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 346 days.

(21) Appl. No.: 10/422,668

(22) Filed: Apr. 24, 2003

(65) Prior Publication Data

US 2004/0214100 A1 Oct. 28, 2004

(51) Int. Cl.
*G03G 5/047* (2006.01)

(52) U.S. Cl. ..... 430/58.05; 430/58.8

(58) Field of Classification Search ..... 430/58.65, 430/59.6, 64, 58.05, 58.8
See application file for complete search history.

(56) References Cited

U.S. PATENT DOCUMENTS

| | | | | |
|---|---|---|---|---|
| 4,233,384 | A | 11/1980 | Turner et al. | 430/59 |
| 4,265,990 | A | 5/1981 | Stolka et al. | 430/59 |
| 4,272,608 | A * | 6/1981 | Proskow | 430/288.1 |
| 4,299,897 | A | 11/1981 | Stolka et al. | 430/59 |
| 4,306,008 | A | 12/1981 | Pai et al. | 430/59 |
| 4,439,507 | A | 3/1984 | Pan et al. | 430/59 |
| 5,928,828 | A * | 7/1999 | Suzuki | 430/126 |
| 6,015,645 | A | 1/2000 | Murti et al. | 430/59 |
| 6,258,499 | B1 * | 7/2001 | Itami | 430/66 |
| 2003/0087171 | A1 * | 5/2003 | Tokutake et al. | 430/58.2 |

OTHER PUBLICATIONS

Robert C.U. Yu et al., "Imaging Members", filed Dec. 16, 2002, U.S. Appl. No. 10/320,808.
Jin Wu et al., "Photoconductive Imaging Members", filed Feb. 19, 2003, U.S. Appl. No. 10/369,816.

* cited by examiner

*Primary Examiner*—John L Goodrow
(74) *Attorney, Agent, or Firm*—E. O. Palazzo

(57) ABSTRACT

A photoconductive imaging member containing a photogenerating layer, a charge transport layer, or a plurality of charge transport layers, and which charge transport, especially the top charge transport layer contains a vinyl containing organic compound.

35 Claims, No Drawings

IMAGING MEMBERS

CROSS-REFERENCE TO RELATED APPLICATIONS

Illustrated in copending U.S. Ser. No. 10/320,808, Publication No. 20040115545, filed Dec. 16, 2002 on Imaging Member by Anthony M. Horgan et at., the disclosure of which is totally incorporated herein by reference, is an imaging member comprised of a photogenerating layer, (1) a first charge transport layer comprised of a charge transport component and a resin binder, and thereover and in contact with the first layer (2) a second top charge transport layer comprised of a charge transport component, a resin binder and a hindered phenol dopant.

There is illustrated in copending U.S. Ser. No. 10/369,816, Publication No. 20040160684, filed Feb. 19, 2003 by Jin Wu et al., entitled Photoconductive Imaging Members, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

There is illustrated in copending U.S. Ser. No. 10/370,186, Publication No. 20040161683, filed Feb. 19, 2003 by Jin Wu et al., entitled Photoconductive Imaging Members, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

The appropriate components and processes of the above copending applications, inclusive of the photogenerating components, the charge transport components and the hole transport components, blocking and adhesive layers, hindered phenol, top overcoating layer, and the like, can be selected for the present invention in embodiments thereof.

BACKGROUND

This invention relates in general to layered imaging members, inclusive of flexible members and substantially rigid members, or OPC members comprised, for example, of a photogenerating layer and a charge transport layer. The charge transport layer comprises in embodiments a charge transport compound, a resin binder, and a vinyl containing organic compound which is substantially compatible with the binder resin and functions primarily as an antiozonant, and which antiozonant prevents, or minimizes resin binder molecular degradation by exposure to ozone. The vinyl containing compound can be a solid or a high boiling liquid having a boiling point of at least about 200° C. to, for example, prevent its loss from the charge transport layer due to evaporation. The charge transport layer in embodiments may also comprise a hindered phenol antioxidant.

More specifically, the present invention relates to an electrophotographic imaging member comprised in sequence of a supporting substrate, a hole blocking layer, an adhesive layer, a photogenerating layer, and a charge transport layer containing charge, especially hole transport components, a polymer binder, a vinyl containing organic compound which is preferably compatible with the polymer binder and functions as an effective antiozonant to eliminate or suppress the polymer binder molecular chain scission to permit the prevention of chain backbone break down into low molecular weight polymer fragments that converts the charge transport layer into a brittle coating layer. Compatibility of the vinyl containing organic compound is of value to enable formation of a homogeneous charge transport material blend with the binder polymer so that presence of the vinyl organic compound avoids or minimizes the development of phase separation in the resulting charge transport layer material matrix. Furthermore, in embodiments the invention electrophotographic imaging members may also contain a plurality of layers, such as two charge transport layers comprising a first (bottom) charge transport layer which is in contiguous contact with the photogenerating layer, and a second (top) charge transport layer coated over the first charge transport layer. The bottom charge transport layer can comprise a binary solid solution of a charge transport compound and a polymer binder, whereas the top charge transport layer is comprised of a charge transport compound, a polymer binder, an effective antiozonant vinyl containing organic compound, and also in embodiments an oxidative stabilizer hindered phenol to prevent charge lateral conductive migration (LCM) associated print defects observable in the output printed copy. Coating of the dual transport layers in separate passes provides, for example, the benefit of minimizing the transport layers thickness variations since these thickness variations can cause undesirable image defects printout (referred to as rain drops) and thus degrade the copy quality.

In specific embodiments of the present invention there are provided imaging members containing an exposed charge transport layer which comprises an organic compound additive with a vinyl terminated group or groups, and which functions primarily as an antiozonant, and which organic compound is, for example, an unsaturated carbonate compound of the following Formula A $$R_1—O—CO_2—R_2—O—R_2—CO_2—O—R_1,$$

wherein $R_1$ is unsaturated vinyl chain with, for example, from about 3 to about 40 carbon atoms, and wherein $R_2$ is different from $R_1$, and wherein $R_2$ is selected from the group consisting of a) a nonsubstituted aliphatic chain with, for example, from about 1 to about 50 carbon atoms, b) a substituted aliphatic chain with, for example, from about 1 to about 50 carbon atoms, c) an unsubstituted aromatic group with, for example, from about 6 to about 30 carbon atoms, d) a substituted aromatic group with, for example, from about 6 to about 30 carbon atoms, e) an unsubstituted heterocyclic group with, for example, from about 3 to about 40 carbons, and f) a substituted heterocyclic group with, for example, from about 3 to about 40 carbons wherein the substituents are selected, for example, from the group consisting of aliphatic groups with from about 1 to about 50 carbons, cycloaliphatic groups with from about 3 to about 28 carbons, halides, aromatic groups with from about 6 to about 30 carbons, nitro groups, amino groups, amido groups, cyano groups, and sulfonyl groups. Moreover, in embodiments the Formula A additive illustrated herein with $R_1$ and $R_2$ being the vinyl termination group and alkylene, such as ethylene segments, respectively; one specific monomer carbonate liquid of Formula A is, for example, a diethylene glycol bis(allyl carbonate) as represented by $$CH_2=CH—CH_2—O—CO—O—CH_2—CH_2—O—CH_2—CH_2—O—CO—O—CH_2—CH=CH_2.$$

Alternatively, in embodiments of the present invention the imaging members are comprised of an unsaturated carbonate compound of bisphenol A carbonate of the following Formula B

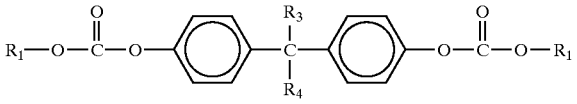

wherein $R_1$ is an unsaturated vinyl chain having from about 3 to about 40 carbon atoms, and $R_3$ and $R_4$ are the same or different, and are selected from the group consisting of a) an unsubstituted aliphatic group having from about 1 to about 50 carbon atoms, and b) a substituted aliphatic group having from about 1 to about 50 carbon atoms, wherein the substituents are selected from the group consisting of aliphatic groups having from about 1 to about 50 carbons, cycloaliphatic groups having from about 3 to about 28 carbon atoms, halides, aromatic groups having from about 6 to about 30 carbons, nitro groups, amino groups, amido groups, sulfonyl groups, and cyano groups. In a specific embodiment, the $R_1$ in bisphenol A carbonate monomer of Formula B is an allyl group.

In addition, the imaging members in embodiments of the present invention may contain an exposed charge transport layer which may further comprise a low molecular weight polystyrene having a vinyl end group as illustrated in Formula C

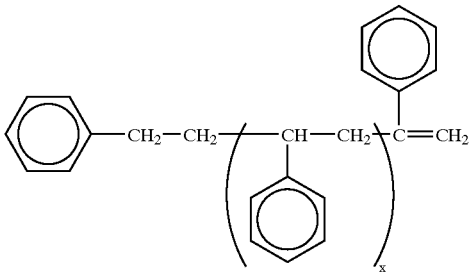

wherein x or R illustrated herein represents the degrees of polymerization and is an integer of, for example, from 0 to 20, and more specifically, from about 7 to about 15.

The imaging members of the present invention avoid or minimize attacks by ozone species present in the corona generated effluents to thereby minimize charge transport layer cracking, wear, and defects and deletions in the printed copy; and more specially, wherein there is minimized in the charge transport layer binder, such as a polycarbonate binder, the chain scission caused primarily by ozonolysis, which in turn results in undesirable cracking in the charge transport layer of the imaging member. The protection against ozone attack and polymer binder chain scission, as a result of the incorporation of a vinyl containing organic compound in the charge transport layer, can be illustrated with reference the following chemical reaction

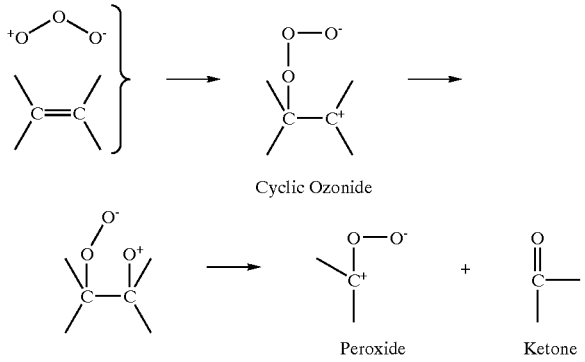

The exposed charge transport layer may also include an antioxidant, such as a hindered phenol, thus deletion (LCM) defects copy printouts caused primarily by the imaging members oxidative interaction between the charge transport compound and the corona species of, for example, nitrogen oxides NOx, and can be eliminated or suppressed.

Advantages associated with the imaging members of the present invention, in embodiments thereof include, for example, the avoidance or minimization of cracking in the charge transport layer, especially microcracking manifestation appearing in the form of defect bands in a copy printout. The microcracks are generated by the interaction of corona effluents and corona emissions typically found to be, for example, from about 5 to about 10 microns in width, and from about 500 to about 800 microns in length resulting in print defects and adversely affecting the functionality while prematurely shortening the service of the member. Moreover, polymer binder chain degradation as a result of ozonolysis attack can also produce another adverse outcome because such degradation is breaking down the molecular chain length of the binder rendering the transport more susceptible to wear against cleaning blades and other contacting subsystems mechanical interactions under a normal imaging member machine functioning condition.

The imaging members may also contain in the exposed charge transport layer a light shock resisting or reducing agent, such as 3,3',5,5'-tetra-tert-butyl-4,4'-diphenoquinone (DPQ); 5,6,11,12-tetraphenyl naphthacene (Rubrene); 2,2'-[cyclohexylidenebis[(2-methyl-4,1-phenylene)azo]]bis[4-cyclohexyl-(9Cl)]; perinones; perylenes; and dibromo anthanthrone (DBA) for minimizing or eliminating light shock effect to thereby impart the imaging member with added excellent electrical functions, improved mechanical characteristics, and copy print out quality enhancements.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this invention are useful in color xerographic applications, particularly high-speed color copying and printing processes, and which members are, in embodiments, sensitive in the wavelength region of, for example, from about 400 to about 900 nanometers, and in particular from about 550 to about 850 nanometers, thus diode lasers can be selected as the light source.

REFERENCES

Electrophotographic imaging members may be multilayered photoreceptors that comprise a substrate support, an electrically conductive layer, an optional charge blocking layer, an optional adhesive layer, a charge generating layer, a charge transport layer, and an optional protective or overcoating layer. The imaging members can be of several forms, including flexible belts, rigid drums, and the like. For a number of multilayered flexible photoreceptor belts, an anticurl layer may be employed onto the backside of the substrate support, opposite to the side transporting the electrically active layers, to achieve the desired photoreceptor flatness.

Various combinations of materials for the charge generating layers and charge transport layers have been disclosed. U.S. Pat. No. 4,265,990, the disclosure of which is totally incorporated herein by reference, illustrates a layered photoreceptor having a separate charge generating layer and a separate charge transport layer. The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Examples of photosensitive members having at least two electrically operative layers including a charge generating layer and a diamine containing transport layer are disclosed in U.S. Pat. Nos. 4,265,990; 4,233,384; 4,306,008; 4,299,897 and 4,439,507, the disclosures of each of these patents being totally incorporated herein by reference.

In multilayered photoreceptor devices, one property of value, for example, is the charge carrier mobility in the transport layer. Charge carrier mobility determines the velocities at which the photoinjected carriers transit the transport layer. For greater charge carrier mobility capabilities, for example, it may be necessary to increase the concentration of the active molecule transport compounds dissolved or molecularly dispersed in the binder. Phase separation or crystallization can establish an upper limit to the concentration of the transport molecules that can be dispersed in a binder. Thus there is desired an imaging member that exhibits excellent performance properties and minimizes lateral conductivity migration of the charge image pattern, and which characteristics may be achievable in embodiments of the present invention.

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxy alkyl polymer of Formula (I) with an organosilane of Formula (II) and water

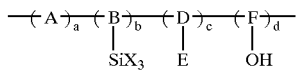

(I)

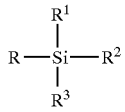

(II)

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

A number of the prior art imaging members can exhibit major mechanical problems such as charge transport layer cracking in a flexible belt configuration or being excessively susceptible to charge transport layer wear under a normal machine functioning conditions. Charge transport layer cracking or wear can result from polymer binder molecular degradation as a consequence of chemical attack by the ozone species emitted from a charging device. These and other disadvantages are avoided or minimized in embodiments of the present invention.

SUMMARY

Aspects of the present invention include an imaging member comprising a photogenerating layer, and a transport layer comprised of charge transport components, polymer binder and a vinyl containing organic antiozonant compound; an imaging member wherein the charge transport layer contains from about 35 to about 65 weight percent of charge transport components, and wherein the vinyl compound is a liquid that possesses a boiling point of at least about 200° C.; an imaging member wherein the liquid content in the charge transport layer is from about 1 to about 15 weight percent based on the total weight of the charge transport layer; an imaging member wherein the charge transport layer comprises a plurality of from about 2 to about 10 charge transport layers; an imaging member wherein the plurality is from about 2 to about 7 layers; an imaging member wherein the top layer contains from about 10 to about 75 weight percent of charge transport components, or wherein the layer contains from about 35 to about 50 weight percent of charge transport components; an imaging member wherein the vinyl compound is a liquid carbonate monomer; an imaging member wherein the carbonate is of the formula $$R_1—O—CO_2—R_2—O—R_2—CO_2—O—R_1$$

wherein each $R_1$ is an unsaturated vinylic group with from about 3 to about 40 carbon atoms, and $R_2$ is an alkyl with 1 to about 50 carbon atoms; an imaging member wherein the carbonate possesses a boiling point equal to about or in excess of about 200° C.; an imaging member wherein the carbonate possesses a boiling point of from about 265° C. to about 325° C.; an imaging member wherein the carbonate is of the formula

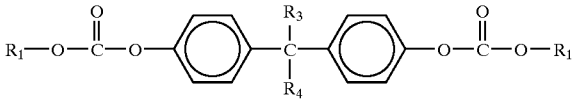

wherein each $R_1$ is an unsaturated vinylic group with from about 3 to about 40 carbon atoms, $R_3$ and $R_4$ are of alkyl with from about 1 to about 50 carbon atoms; an imaging member wherein the carbonate possesses a boiling point equal to about or in excess of about 200° C.; an imaging member wherein the vinyl compound is an oligomer of polystyrene of the formula

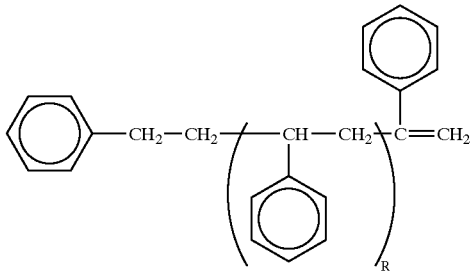

wherein R represents the degree of polymerization; an imaging member wherein the antiozonant is a carbonate present in an amount of from about 1 to about 15 weight percent, or present in an amount of from about 2 to about 10 weight percent; an imaging member further containing in the charge transport layer a hindered phenol; an imaging member wherein the hindered phenol is present in the charge transport layer in an amount of from about 1 to about 15 weight percent, or wherein the hindered phenol is present in an amount of from about 5 to about 10 weight percent; an imaging member wherein the hindered phenol is pentaerythritol tetrakis(3-(3,5-di-tert-butyl-4-hydroxyphenyl)propionate); an imaging member wherein the charge transport layer contains

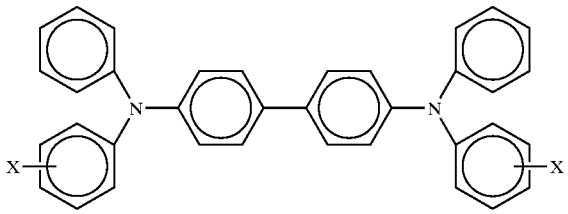

wherein X is alkyl; an imaging member further comprising an adhesive layer and an overcoat layer; an imaging member further containing a substrate with a thickness of from about 50 to about 1,000 micrometers; an imaging member wherein the substrate is in the form of a flexible web, and wherein the substrate possesses a thickness of from about 75 to about 150 micrometers, or wherein the substrate is in the form of a rigid component and wherein the substrate possesses a thickness of from about 500 to about 1,000 micrometers; an imaging member further containing a charge blocking layer of zinc oxide, titanium oxide, a silane, a silica, polyvinyl butyral, or a phenolic resin; an imaging member wherein the charge generating layer comprises metal free phthalocyanines, metal phthalocyanines, vanadyl phthalocyanines, perylenes, titanyl phthalocyanines, hydroxy gallium phthalocyanines, selenium, selenium alloys, or mixtures thereof; an imaging member wherein the charge generating layer comprises Type V hydroxygallium phthalocyanine; an imaging member wherein the polymer binder in the charge transport layer is a polycarbonate; an imaging member wherein the polycarbonate polymer binder is present in an amount of from about 25 to about 90 percent by weight; an imaging member wherein the member is in the form of a flexible web; an imaging member comprising a photogenerating layer (1) a first charge transport layer in contact with the photogenerating layer and wherein the first charge transport is comprised of a charge transport component, a resin binder, and thereover and in contact with the first charge transport layer; (2) a plurality of charge transport layers each comprised of a charge transport component, and resin binder, and wherein the top charge transport layer contains a vinyl containing compound; an imaging member wherein the first layer contains from about 35 to about 75 weight percent of the charge transport components, and wherein the vinyl compound is a solid or a liquid; an imaging member comprising a photogenerating layer, and a transport layer comprised of charge transport components, polymer binder and a vinyl containing organic compound antiozonant, and wherein the vinyl compound is a carbonate monomer of diethylene glycol bisallyl carbonate, diethylene glycol bispropylene carbonate, diethylene glycol bisbutylene carbonate, dipropyl glycol bisallyl carbonate dibutyl glycol bisallyl carbonate, bisphenol A bisallyl carbonate, or bisphenol A bisbutylene carbonate, and the like; an electrophotographic imaging member comprising a photogenerating layer and a plurality of charge transport layers, or a single outermost exposed charge transport layer, wherein the charge transport layer comprises a polymer binder, a charge transport component, a hindered phenol such as an IRGANOX™ like octadecyl-3,5-di-tert-butyl-4-hydroxyhydrocinnamate, available from Ciba Specialty Chemicals, and a vinyl containing organic compound additive, and wherein the hindered phenol functions as an antioxidant and the vinyl containing organic compound additive functions as antiozonant to prevent polymer chain scission or fragmentation caused by ozone attack wherein the vinyl containing organic compound is an unsaturated compound which can be a solid, or high boiling liquid having a boiling point of at least 200° to prevent its eventual loss from the charge transport layer due to evaporation wherein the antiozonant is an unsaturated organic compound carbonate compound of the Formula A $$R_1—O—CO_2—R_2—O—R_2—CO_2—O—R_1,$$

wherein $R_1$ is an unsaturated vinyl chain having from about 3 to about 45 carbon atoms, and more specifically, from about 10 to about 25 carbon atoms, and wherein $R_2$ is dissimilar than $R_1$ and wherein $R_2$ is selected from the group consisting of a) a nonsubstituted aliphatic chain having from about 1 to about 50 carbon atoms, b) a substituted aliphatic chain having from about 1 to about 50 carbon atoms, c) an unsubstituted aromatic group having from about 6 to about 30 carbon atoms, d) a substituted aromatic group having from about 6 to about 36 carbon atoms, e) unsubstituted heterocyclic group having from about 3 to about 40 carbons, and f) substituted heterocyclic group having from about 3 to about 40 carbons, wherein the substituents are selected from the group consisting of aliphatic groups, such as alkyl, with from about 1 to about 50 carbons, cycloaliphatic groups with about 3 to about 28 carbons, halides, aromatic groups like phenyl with from about 6 to about 30 carbons, nitro groups, amino groups, amido groups, cyano groups, and sulfonyl groups.

Alternatively, in embodiments of the present invention the imaging members can contain in the charge transport layer an unsaturated carbonate compound of the following Formula B

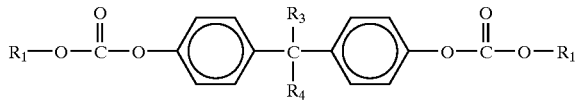

wherein each $R_1$ is an unsaturated vinyl chain with from about 3 to about 40, and more specifically, from about 12 to about 25 carbon atoms, and $R_3$ and $R_4$ are the same or different and are selected from the group consisting of a) an unsubstituted aliphatic group having from about 1 to about 50 carbon atoms, and b) a substituted aliphatic group having from about 1 to about 50 carbon atoms, wherein the substituents are selected from the group consisting of aliphatic groups having from about 1 to about 50 carbons, cycloaliphatic groups having from about 3 to about 28 carbon atoms, halides, aromatic groups having from about 6 to about 30 carbons, nitro groups, amino groups, amido groups, sulfonyl groups, and cyano groups.

In addition, the imaging members in embodiments of the present invention can contain first or second an exposed charge transport layer which contains a low molecular weight oligomeric polystyrene additive with a vinyl end group as shown in the Formula C

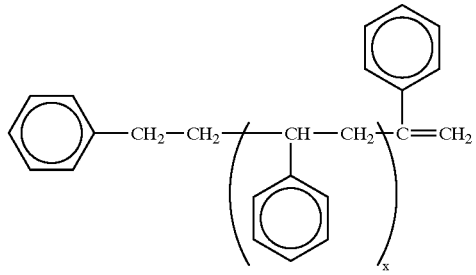

wherein x is the degree of polymerization, and more specifically, wherein x is from about zero (0) to about 20.

The capability of protecting the charge transport layer against ozone attack polymer binder chain scission, by each of the vinyl containing compounds illustrated herein, can be elucidated by the following chemical reaction, although it is not desired to be limited by theory.

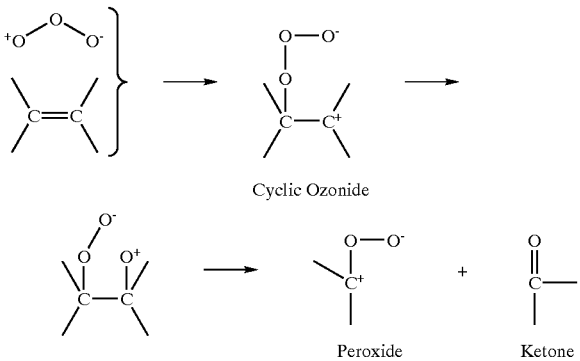

Further, specific aspects of the present invention relate to an imaging member comprised of a photogenerating layer (1) a first (bottom) charge transport layer comprised of a charge transport component and a resin binder, and thereover and in contagious contact with the first charge transport layer (2) second (top) charge transport layer comprised of a charge transport component, a binder resin or polymer, a hindered phenol, such as an IRGANOX™ like octadecyl-3,5-di-tert-butyl-4-hydroxyhydrocinnamate, available from Ciba Specialty Chemicals, and a vinyl containing organic compound additive. For the application of each of the charge transport layers, there can be selected a number of known suitable organic solvents, such as methylene chloride, toluene, trichloroethane, trichloroethylene, chlorobenzene and tetrahydrofuran, and wherein the ratio of total solid, that is the amount of charge transport compound and binder plus additives when present, to the total solvent amount used in coating solution is, for example, from about 10:90 weight percent to about 30:70 weight percent, and in embodiments from about 15:85 weight percent to about 25:75 weight percent. More specifically, in embodiments the charge transport can be deposited in an appropriate number of passes depending on the number of layers desired for the resulting imaging member. For example, for a single charge transport layer only one pass is needed; for four charge transport layers, four separate passes are sequentially applied, and wherein the first pass forms the first (bottom) charge transport layer coated directly over the photogenerating layer prior to the application of the second and succeeding layers; that is the second charge transport layer is coated on the first charge transport layer, and the second layer is further coated over with subsequent layers to provide multiple charge transport layers.

For an imaging member employing a plurality, such as two charge transport layers, the first (bottom) charge transport layer in contact with the photogenerator layer is, for example, comprised of a suitable charge transport compound, such as an aryl amine, like N,N'-diphenyl-N,N'-bis(3-methylphenyl)-[1,1'-biphenyl]-4,4'-diamine and a polymer binder, such as polycarbonate; and the second (top) charge transport layer in contagious contact with the first charge transport layer can comprise suitable amounts of charge transport compounds as illustrated herein, such as an aryl amine like N,N'-diphenyl-N,N'-bis(3-methylphenyl)-[1,1'-biphenyl]-4,4'-diamine, a polymer binder which may be the same or different from that used in the first charge transport layer, a hinder phenol antioxidant, and a vinyl organic compound functioning as an antiozonant. Any suitable and conventional techniques may be utilized to apply the charge transport layer coating's solutions, such as for example, spraying, dip coating, extrusion coating, roll coating, wire wound rod coating, draw bar coating, and the like.

More specifically, in an imaging member with multiple charge transport layers, the first (bottom) charge layer can comprise a suitable charge transport compound, such as an aryl amine, like N,N'-diphenyl-N,N'-bis(3-methylphenyl)-[1,1'-biphenyl]-4,4'-diamine and a polymer binder, such as a polycarbonate; and the second and succeeding charge transport layers can comprise suitable amounts of charge transport compounds as illustrated herein, such as an aryl amine like N,N'-diphenyl-N,N'-bis(3-methylphenyl)-[1,1'-biphenyl]-4,4'-diamine, a polymer binder which may be the same or different from the binder used in the first charge transport layer, a hinder phenol antioxidant, and a vinyl containing organic compound, and yet more specifically, the multiple charge transport layers comprise N,N'-diphenyl-N,N'-bis(3-methylphenyl)-[1,1'-biphenyl]-4,4'-diamine and a polymer binder, such as polycarbonate, and wherein the very top outermost exposed charge transport layer also comprises additives such as a hindered phenol antioxidant (IRGANOX™ 1010) and a vinyl containing organic compound.

Each of the resulting dried charge transport layers possess, in embodiments, a thickness of from about 5 to about 50 micrometers, and more specifically, a thickness of, for example, from about 10 to about 30 micrometers. In specific embodiments, the total thickness of the plurality, such as from about 2 to about 7 charge transport layers, is from about 15 to about 200 micrometers, more specifically from about 20 to about 100 micrometers, and yet more specifically, from about 25 to about 40 micrometers. In general, the ratio of the thickness of the first charge transport layer to the charge generating layer is, in embodiments, maintained at from about 2:1 to about 200:1, and in some instances about 400:1, and wherein the second and succeeding charge transport layers, especially the top charge transport layer, possess excellent wear resistance. The top charge transport layer, if desired, may also contain inorganic or organic fillers, such as silica, metal oxides, and PTFE particles dispersion to impart further wear resistant enhancement.

The charge generating layer, charge transport layers and optional layers may be applied in any suitable order to provide either positive or negative charging photoreceptors. For example, the charge generating layer may be applied prior to the charge transport layer, as illustrated in U.S. Pat. No. 4,265,990, or the charge transport layers may be applied prior to the charge generating layer, as illustrated in U.S. Pat. No. 4,346,158, the entire disclosures of these patents being totally incorporated herein by reference. Also, in embodiments the charge transport layers are coated upon the charge generating layer, and the top charge transport layers may optionally be overcoated with an overcoat and/or protective layer.

Examples of high boiling additive antiozonant liquids are those with a boiling point that is in excess of 200° C., and more specifically, from about 265° C. to about 325° C.; and yet more specifically, be greater than about 250° C. Any one of the high boiling liquids of the above mentioned Formulas A, B, and C may be selected in various effective amounts, such as for example, from about 1 to about 15 percent by weight, and more specifically, from about 2 to about 10 percent by weight based on the total weight of the charge transport layer. While not being desired to be limited by theory, it is believed that the resistance of the charge transport layer components against ozone results from the interaction between ozone molecules and the phi-bond in the vinyl end group(s) of the selected additive that is present in the material matrix of the coating layer; and more specifically, it is believed that the vinyl end group(s) of the carbonate monomer liquid of Formulas A and B and the polystyrene oligomer of Formula C can function as antiozonants to thereby neutralize the ozone species and prevent/eliminate their attacks on the polycarbonate binder of the charge transport layer which ozone attacks can cause polycarbonate chain scissions and break down the molecular weight of the binder to thereby weaken the mechanical properties of the layer.

Specific examples of vinyl compounds are carbonate monomers, such as for example diethylene glycol bisallyl carbonate, diethylene glycol bispropylene carbonate, diethylene glycol bisbutylene carbonate, dipropyl glycol bisallyl carbonate dibutyl glycol bisallyl carbonate, bisphenol A bisallyl carbonate, bisphenol A bisbutylene carbonate, and the like, or dimer, a trimer, a tetramer styrene, or an allyl benzene.

A number of suitable substrates, including known substrates, can be selected for the imaging members fabrication of the present invention, examples of which are opaque or substantially transparent, and suitable organic or inorganic material. The substrate for a flexible imaging member belt application can thus be formulated entirely of an electrically conductive material, or it can be comprised of an insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium, and the like, or exclusively be made up of a conductive material, such as aluminum, chromium, nickel, brass, and the like. The substrate selected for flexible imaging member belts and scroll fabrication can be from a flexible web stock or a seamed or seamless belt; or it can also be a rigid drum, a plate, and the like for rigid imaging members.

For example, in embodiments the back of the substrate, particularly when the substrate is a flexible organic polymeric material, may comprise an electrically conductive surface, and wherein the thickness of the substrate layer depends on numerous factors, including mechanical performance and economic considerations; thus, thickness of this layer may be from about 50 micrometers to about 1,000 micrometers, and in embodiments from about 75 micrometers to about 150 micrometers for optimum flexibility and minimal induced surface bending stress when the fabricated imaging member belt is cycled around small diameter belt module support rollers, for example 19 millimeter diameter rollers. The surface of the substrate layer can be cleaned prior to its application of a coating to promote greater adhesion of the deposited coating composition. Cleaning may be effected by, for example, exposing the surface of the substrate layer to plasma discharge, ion bombardment, and the like. The entire substrate can comprise the same material as that in the electrically conductive surface or the electrically conductive surface can be merely a coating on the substrate. Examples of electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, indium, tin, metal oxides, including tin oxide and indium tin oxide, and the like.

The conductive layer of the substrate can vary in thickness over substantially wide ranges depending on the desired use of the electrophotoconductive member. Generally, the conductive layer thickness is from about 50 Angstroms to about 1,000 Angstroms. When a flexible electrophotographic imaging member is desired to, for example, enable a dynamic photoelectrical cycling belt function, the thickness of the conductive layer is typically ranging from about 20 Angstroms to about 750 Angstroms, and in embodiments from about 100 to about 200 Angstroms.

A charge blocking layer may be applied to the substrate and in contact with the conductive layer, or in contact with the substrate when a conductive layer is absent. Generally, electron blocking layers for positively charged photoreceptors allow the photogenerated holes in the charge generating layer at the surface of the photoreceptor to migrate toward the charge (hole) transport layer below and reach the bottom conductive layer during the electrophotographic imaging processes. Thus, an electron blocking layer is normally not expected to block holes in positively charged photoreceptors such as photoreceptors coated with a charge generating layer over a charge (hole) transport layer. For negatively charged photoreceptors, any suitable hole blocking layer capable of forming as an electronic barrier to holes between the adjacent photoconductive layer and the underlying conductive layer, such as zirconium or titanium layer, may be utilized. A hole blocking layer may comprise any suitable material of, for example, polymers such as polyvinylbutyral, epoxy resins, polyesters, polysiloxanes, polyamides, polyurethanes, and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl) isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)-methyl diethoxysilane, and $[H_2N(CH_2)_3]CH_3Si(OCH_3)_2$, (gamma-aminopropyl)-methyl diethoxysilane, as in U.S. Pat. Nos. 4,338,387; 4,286,033 and 4,291,110, the disclosures of which are totally incorporated herein by reference. Other suitable charge blocking layer polymer compositions are described in U.S. Pat. No. 5,244,762, such as vinyl hydroxyl ester and vinyl hydroxy amide polymers, wherein the hydroxyl groups have been partially modified to benzoate and acetate esters that modified polymers are then blended with other unmodified vinyl hydroxy ester and amide unmodified polymers. An example of such a blend is a 30 mole percent benzoate ester of poly(2-hydroxyethyl methacrylate) blended with the polymer poly(2-hydroxyethyl methacrylate). Still other suitable charge blocking layer polymer compositions are described in U.S. Pat. No. 4,988,597, the disclosure of which is totally incorporated herein by reference, an example of an alkyl acrylamidoglycolate alkyl ether containing polymer is the copolymer of poly(methyl acrylamidoglycolate methyl ether-co-2-hydroxyethyl methacrylate).

The blocking layer in embodiments may be continuous and may have a thickness of from about 0.05 and about 10 micrometers, and more specifically, from about 1 to about 5 micrometers. In embodiments, a blocking layer of from about 0.05 micrometer to about 1.5 micrometers facilitates charge neutralization after the exposure step and optimum electrical performance is achieved. The blocking layer may be applied by any suitable conventional technique such as spraying, dip coating, draw bar coating, gravure coating, silk screening, air knife coating, reverse roll coating, vacuum deposition, chemical treatment, and the like. For convenience in obtaining thin layers, the blocking layer is, in embodiments, applied in the form of a dilute solution with the solvent being removed after deposition of the coating by conventional techniques such as by vacuum, heating, and the like. Generally, a weight ratio of blocking layer material and solvent of between about 0.05:100 to about 5:100 is satisfactory for spray coating.

An optional adhesive layer, such as polyester, may be formed on the blocking layer, and more specifically, between the blocking layer and the photogenerating layer. Any suitable solvent may be used to form an adhesive layer coating solution, such as tetrahydrofuran, toluene, hexane, cyclohexane, cyclohexanone, methylene chloride, 1,1,2-trichloroethane, monochlorobenzene, and the like, and mixtures thereof. Typical coating techniques include extrusion coating, gravure coating, spray coating, wire wound bar coating, and the like. The adhesive layer can, for example, be applied directly to the blocking layer, thus, the adhesive layer is in embodiments in direct contiguous contact with both the underlying blocking layer and the overlying photogenerating layer to enhance adhesion bonding and to effect ground plane hole injection suppression. Drying of the deposited coating may be effected by any suitable conventional process such as oven drying, infrared radiation drying, air drying, and the like. The adhesive layer should be continuous and can be of a thickness of from about 0.01 micrometer to about 2 micrometers after drying. In embodiments, the dried thickness is from about 0.03 micrometer to about 1 micrometer.

The components of the photogenerating layer comprise photogenerating particles of, for example, known compounds, such as hydroxy gallium phthalocyanines like Type V hydroxygallium phthalocyanine; x-polymorph metal free phthalocyanines, perylenes, titanyl phthalocyanines, metal phthalocyanines, selenium, selenium alloys, chlorogallium phthalocyanines and the like, photogenerating pigments optionally dispersed in a binder polymer. Type V hydroxygallium phthalocyanine possesses X-ray powder diffraction (XRPD) peaks at, for example, Bragg angles (2 theta +/−0.2°) of 7.4, 9.8, 12.4, 16.2, 17.6, 18.4, 21.9, 23.9, 25.0, 28.1, with the highest peak at 7.4 degrees. The X-ray powder diffraction traces (XRPDs) were generated on a Philips X-Ray Powder Diffractometer Model 1710 using X-radiation of CuK-alpha wavelength (0.1542 nanometer). The diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter. Type V hydroxygallium phthalocyanine may be prepared by hydrolyzing a gallium phthalocyanine precursor including dissolving the hydroxygallium phthalocyanine in a strong acid, and then reprecipitating the resulting dissolved precursor in a basic aqueous media; removing any ionic species formed by washing with water; concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles in embodiments have an average particle size of less than about 5 micrometers.

Photogenerating layer thicknesses of from about 0.05 micrometer to about 10 micrometers can be selected and in embodiments this layer can be from about 0.3 micrometer to about 3 micrometers in thickness. The photogenerating binder layer containing photoconductive compositions and/or pigments, and the resinous binder material in embodiments, ranges in thickness of from about 0.1 micrometer to about 5 micrometers; and in embodiments, has a thickness of from about 0.3 micrometer to about 3 micrometers for improved light absorption and improved dark decay stability and mechanical properties.

For example, from about 10 percent by volume to about 95 percent by volume of the photogenerating pigment may be dispersed in from about 40 percent by volume to about 60 percent by volume of the film forming polymer binder composition, and in embodiments from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and in embodiments from about 25 to about 75 percent by weight, and the binder is present in an amount of from about 20 to about 95 percent by weight, and in embodiments from about 25 to about 75 percent by weight, although the relative amounts can be outside these ranges. The photogenerating layer containing photoconductive compositions and the resinous binder material generally ranges in thickness of from about 0.05 to about 10 micrometers or more, and in embodiments from about 0.1 to about 5 micrometers, and in more specific embodiments having a thickness of from about 0.3 to about 3 micrometers, although the thickness may be outside these ranges. The photogenerating layer thickness is related to the relative amounts of photogenerating compound and binder with the photogenerating material often being present in amounts of from about 5 to about 100 percent by weight. Higher binder content compositions generally require thicker layers for photogeneration. Generally, it is desirable to provide the photogenerating layer in a thickness sufficient to absorb about 90 percent or more of the incident radiation which is directed upon it in the imagewise or printing exposure step. The maximum thickness of this layer is dependent primarily upon factors, such as mechanical considerations, the specific photogenerating compound selected, the thicknesses of the other layers, and whether a flexible photoconductive imaging member is desired. The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infrared radiation drying, air drying, and the like.

Any suitable film forming binder when present may be utilized as a binder for the photoconductive or photogenerating layer. Examples of suitable binders include thermoplastic and thermosetting resins, such as polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinones, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

The charge transport layer is normally transparent in a wavelength region in which the electrophotographic imaging member is to be used when exposure is effected there through to ensure that most of the incident radiation is utilized by the underlying charge generating layer. The charge transport layer should exhibit negligible charge generation, and discharge if any, when exposed to a wavelength of light useful in xerography, such as from about 4,000 to about 9,000 Angstroms. When used with a transparent substrate, imagewise exposure or erase may be accomplished through the substrate with all light passing through the substrate. Thus, the charge transport material need not transmit light in the wavelength region of use if the charge generating layer is sandwiched between the substrate and the charge transport layer. The charge transport layer in conjunction with the charge generating layer is in embodiment an insulator to the extent that an electrostatic charge placed on the charge transport layer is not conducted in the absence of illumination. The charge transport layer should trap minimal charges either holes or electrons as the case may be passing through it. Generally, there can be selected for the charge transport layer a number of known charge transport components, including for example aryl amines such as those of the following formula

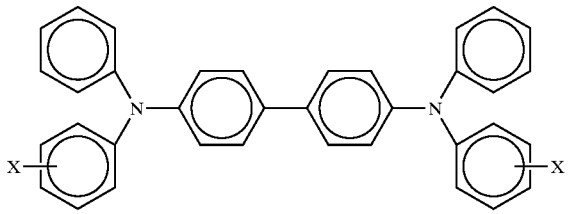

wherein X is an alkyl group, a halogen, or mixtures thereof, especially those substituents selected from the group consisting of Cl and $CH_3$ mixed with a film forming polymer binder and of a thickness of from about 5 to about 75 micrometers, and more specifically, of a thickness of from about 10 to about 40 micrometers.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the film forming polymer binder materials for the charge transport layer include components, such as those illustrated in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly (cyclo olefins), and epoxies as well as block, random or alternating copolymers thereof. Typically, the transport layer contains from about 10 to about 75 percent by weight of a charge transport component, and more specifically, from about 35 percent to about 50 percent of this component molecularly dispersed or dissolved in a polymer binder.

Specific inactive binders selected for the charge transport layer include polycarbonate resins with a weight average molecular weight of from about 20,000 to about 250,000, or a weight average molecular weight of from about 80,000 to about 250,000. More specifically, binders that can be selected are poly(4,4'-isopropylidene diphenyl carbonate) binder with a weight average molecular weight of 120,000; poly(4,4'-diphenyl-1,1'-cyclohexane carbonate) with a weight average molecular weight of 250,000. The resulting polycarbonate charge transport layer containing the invention vinyl containing antiozonant additive may also include an antioxidant pentaerythritol tetrakis(3-(3,5-di-tert-butyl-4-hydroxyphenyl)propionate) (IRGANOX™ 1010 in an amount of from about 1 to about 15 weight percent based on the total weight of the layer). In specific embodiments wherein dual charge transport layers are selected for the imaging member, the first charge transport layer comprises about 35 to about 75 weight percent N,N'-diphenyl-N,N'-bis(3-methylphenyl)-[1,1'-biphenyl]-4,4'-diamine in about 65 to about 25 weight percent polycarbonate binder and followed by a second (top) charge transport layer consisting of N,N'-diphenyl-N,N'-bis(3-methylphenyl)-[1,1'-biphenyl]-4,4'-diamine, a vinyl containing antiozonant additive, and pentaerythritol tetrakis(3-(3,5-di-tert-butyl-4-hydroxyphenyl)propionate) (IRGANOX™ 1010).

Micron size inorganic or organic particle dispersion can also be included to the top charge transport layer to achieve filler reinforcement; examples of fillers being silica, metal oxides, silicates, and the like; while organic fillers are, for example, TEFLON®, stearates, waxy polyethylene particles, salts of fatty acids, and the like, and/or an overcoat protective layer can be utilized to improve resistance of the photoreceptor to abrasion. In some instances, an anticurl back coating may be applied to the surface of the substrate opposite to that bearing the photoconductive layer to provide flatness and/or abrasion resistance where a web configuration photoreceptor is fabricated. These overcoating and anticurl back coating layers can comprise thermoplastic organic polymers or inorganic polymers that are electrically insulating or slightly semiconductive. Usually the overcoating is continuous and possesses a thickness of less than about 10 microns such as from 1 to about 7 microns. The thickness of anticurl backing layers generally is sufficient to balance substantially the total forces of the layer or layers on the opposite side of the substrate layer. An example of an anticurl backing layer is illustrated in U.S. Pat. No. 4,654,284, the disclosure of which is totally incorporated herein by reference. The use of overcoat layer can further increase the wear life of the photoreceptor, the overcoat possessing, for example, a wear rate of about 2 to about 4 microns per 100 kilocycles, or a wearability to from about 150 to about 300 kilocycles in a xerographic imaging apparatus.

Also included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The invention will further be illustrated in the following nonlimiting examples, it being understood that these examples are intended to be illustrative only and that the invention is not intended to be limited to the materials, conditions, process parameters and the like recited herein. All proportions are by weight unless otherwise indicated.

CONTROL EXAMPLE

An electrophotographic imaging member web stock was prepared by providing a 0.02 micrometer thick titanium layer coated on a substrate of a biaxially oriented polyethylene naphthalate substrate (KADALEX™, available from ICI Americas, Inc.) having a thickness of 3.5 mils (89 micrometers). The titanized KADALEX™ substrate was coated with a blocking layer solution containing a mixture of 10 grams of gamma aminopropyltriethoxy silane, 10.1 grams of distilled water, 3 grams of acetic acid, 684.8 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer was of an average dry thickness of 0.05 micrometer as measured with an ellipsometer.

An adhesive interface layer was then deposited by applying to the blocking layer a wet coating solution containing 5 percent by weight of the polyester MOR-ESTER 49,000®, having a weight average molecular weight of about 70,000, available from Morton International, and based on the total weight of the solution in a 70:30 volume ratio mixture of tetrahydrofuran/cyclohexanone. The adhesive interface layer was allowed to dry for 5 minutes at 135° C. in a forced air oven. The resulting adhesive interface layer had a dry thickness of 0.065 micrometer.

The adhesive interface layer was thereafter coated with a photogenerating layer. The photogenerating layer dispersion was prepared by adding 0.45 gram of IUPILON 200®, a polycarbonate of poly(4,4'-diphenyl)-1,1'-cyclohexane carbonate (PC-z 200) available from Mitsubishi Gas Chemical Corporation, and 50 milliliters of tetrahydrofuran into a 4 ounce glass bottle. 2.4 Grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 micrometer. This photogenerating layer comprised of poly (4,4'-diphenyl)-1,1'-cyclohexane carbonate, tetrahydrofuran and hydroxygallium phthalocyanine was dried at 135° C. for 5 minutes in a forced air oven to form a dry photogenerating layer having a thickness of 0.4 micrometer.

The above coated imaging member web was then overcoated with two separate charge transport layers and a ground strip layer using an extrusion co-coating process. Both charge transport layers were prepared by introducing into an amber glass N,N'-diphenyl-N,N'-bis(3-methylphenyl)-1,1'-biphenyl-4,4'-diamine hole transporting compound represented by

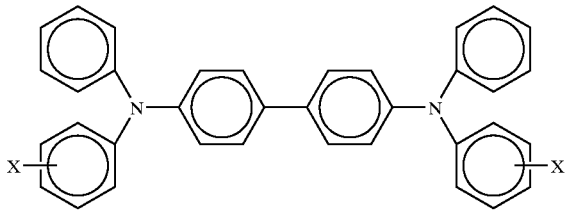

wherein X is a methyl group attached to the meta position. Additionally, MAKROLON 5705®, a bisphenol A polycarbonate, poly(4,4'-isopropylidene diphenyl) carbonate, having a weight average molecular weight of about 120,000 and available from Bayer AG, was added to the charge transport layer solution. The resulting mixture was dissolved to provide a solution containing 15 weight percent solids in 85 weight percent methylene chloride. This solution was applied onto the photogenerating layer to form a first (bottom) charge transport layer which upon drying had a thickness of 15 micrometers. The same coating solution was then subsequently applied as a second (top) charge transport layer and dried to form a 14 micron thick top charge transport layer. Both the top and bottom charge transport layers comprised 50 percent by weight of the above hole transporting compound and 50 percent by weight of a polycarbonate MAKROLON® binder based on the total weight of each layer.

The approximately 10 millimeter wide strip of the adhesive layer left uncoated by the photogenerator layer was coated over with a ground strip layer during the co-coating process. This ground strip layer, after drying together with the co-coated charge transport layer at 135° C. in a forced air oven for 5 minutes, had a dried thickness of about 19 micrometers.

An anticurl layer coating was prepared by combining 8.82 grams of polycarbonate resin, MAKROLON 5705®, available from Bayer AG, 0.72 gram of polyester resin, VITEL PE-200™, available from Goodyear Tire and Rubber Company, and 90.1 grams of methylene chloride in a glass container to form a coating solution containing 8.9 weight percent solids. The container was covered tightly and placed on a roll mill for about 24 hours until the polycarbonate and polyester were dissolved in the methylene chloride to form the anticurl coating solution. The anticurl coating solution was then applied to the rear surface (side opposite the photogenerator layer and charge transport layer) of the imaging member web stock by extrusion coating process, and dried at 135° C. for about 5 minutes in a forced air oven to produce a dried film thickness of about 17 micrometers.

Comparative Example

An electrophotographic imaging member web stock was prepared using the same materials and the same process as that described in the above Example, but with the exception that the top charge transport layer also comprised 6.8 percent by weight of the antioxidant IRGANOX 1010®, pentaerythritol tetrakis(3-(3,5-di-tert-butyl-4-hydroxyhenyl)propionate) available from Ciba Spezialitatenchemie AG.

Example I

Three electrophotographic imaging member web stocks were prepared using the same materials and the same procedures as those described in the Comparative Example, but with the exception that the top charge transport layer of each web stock was incorporated with 1, 2, and 4 weight percent, respectively, of an unsaturated carbonate liquid of Formula A, and more specifically, an allyl diglycol carbonate with the following molecular formula $$CH_2{=}CH{-}CH_2{-}O{-}CO{-}O{-}CH_2{-}CH_2{-}O{-}CH_2{-}CH_2{-}O{-}CO{-}O{-}CH_2{-}CH{=}CH_2$$

The above formula compound is a diethylene glycol bis allyl carbonate monomer (commercially available from PPG Industries, Inc) and has a boiling point of about 290° C.

Example II

Four electrophotographic imaging member web stocks were prepared using the same materials and the same procedures as those described in the Comparative Example, but with the exception that the top charge transport layer of each web stock was incorporated with 1, 2, 4, and 8 weight percent of an unsaturated carbonate liquid of a bisphenol A carbonate encompassed by the formula

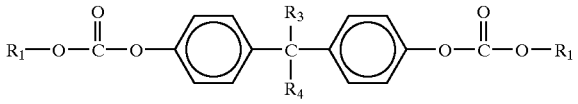

The above liquid compound is a bisphenol A bisallyl carbonate monomer having two vinyl terminating groups (commercially available from PPG Industries, Inc) and having a boiling point of about 300° C.

Photoelectrical and Corona Exposure Testings

The imaging member web stocks of all the above Examples were evaluated for photoelectrical properties and corona effluents exposure tests.

The photoelectrical testing results obtained from the electrical scanner showed that imaging members prepared with the same material formulation in both the bottom and top charge transport layers reference the imaging member of the Control Example; the top charge transport layer with 6.8 weight percent IRGANOX™ addition in the imaging member of the Comparative Example; and the top charge transport layer with 6.8 weight percent of IRGANOX™ and 1, 2, and 4 weight percent of monomer liquid incorporation in their respective imaging members provided approximately equivalent electrical functional characteristic such as photoelectrical cyclic stability, photodischarge sensitivity, dark decay potential, depletion voltage, and background and residual voltage. These results indicated that the incorporation of the carbonate monomer additives to the top charge transport layer did not cause deleterious photoelectrical impacts for the fabricated imaging members.

The above five imaging members were then cut to provide five 2"×3" sample pieces, followed by individually rolling each, with the charge transport layer facing outwardly, into a 19 millimeter diameter sample tube. These imaging member sample tubes were then subjected to corona effluents exposure tests. Corona effluents were generated by turning on a charging device in an enclosed large glass tubing operated under 700 micro-amperes and 8 KV conditions. The corona effluent exposure test was accomplished by placing these imaging member sample tubes inside the enclosed glass tube and simultaneously exposing the samples to the gaseous effluents for 6 hours time duration. Examination of the samples, under 70× magnification with an optical microscope, after exposure indicated corona species interaction with the imaging member charge transport layer, while the sample was under a bending angle or bending strain condition, indicated extensive charge transport layer cracking in the Control and the Comparative Examples which had a 6.8 weight percent antioxidant IRGANOX™ in the charge transport layer. The cracks had a characteristic length of about 40 micrometers in average length, and the cracks in the charge transport layer did manifest themselves into print copy defects. Molecular weight analysis of the charge transport layer after corona exposure indicated significant polycarbonate molecular weight reduction as compared to a control charge transport layer counterpart without corona exposure. In contrast, the imaging members containing the carbonate monomer liquid were all free of charge transport layer cracking, indicating that the polymer binder chain scission caused by corona effluents induced ozonolysis attack was effectively eliminated.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An imaging member comprising a photogenerating layer, and a transport layer comprised of a charge transport component, polymer binder and from about 1 to about 15 weight percent based on the total weight of the charge transport layer an organic liquid compound additive with a vinyl terminated group or groups having a boiling point of at least about 200° C., and which functions primarily as an antiozonant.

2. An imaging member in accordance with claim 1 wherein said charge transport layer contains from about 35 to about 65 weight percent of charge transport components and said binder is a polycarbonate.

3. An imaging member in accordance with claim 2 wherein said liquid content in the charge transport layer is from weight percent based on the total weight of the charge transport layer.

4. An imaging member in accordance with claim 1 wherein said charge transport layer comprises a plurality of from about 2 to about 10 charge transport layers.

5. An imaging member in accordance with claim 4 wherein said plurality is from about 2 to about 7 layers.

6. An imaging member in accordance with claim 4 wherein said top layer contains from about 10 to about 75 weight percent of said charge transport component.

7. An imaging member in accordance with claim 1 wherein said vinyl compound is a liquid carbonate monomer.

8. An imaging member in accordance with claim 7 wherein said carbonate is of the formula $$R_1—O—CO_2—R_2—O—R_2—CO—O—R_1$$

wherein each $R_1$ is an unsaturated vinylic group with from about 3 to about 40 carbon atoms, and $R_2$ is an alkyl with 1 to about 50 carbon atoms.

9. An imaging member in accordance with claim 8 wherein said carbonate possesses a boiling point equal to about or in excess of about 200° C.

10. An imaging member in accordance with claim 8 wherein said carbonate possesses a boiling point of from about 265° C. to about 325° C.

11. An imaging member in accordance with claim 7 wherein said carbonate is of the formula

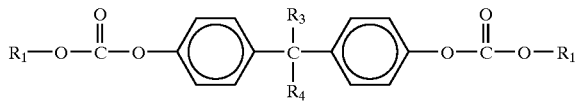

wherein each $R_1$ is an unsaturated vinylic group with from about 3 to about 40 carbon atoms, and each $R_3$ and $R_4$ are alkyl with from about 1 to about 50 carbon atoms.

12. An imaging member in accordance with claim 11 wherein said carbonate possesses a boiling point equal to about or in excess of about 200° C.

13. An imaging member in accordance with claim 1 wherein said vinyl compound is an oligomer of polystyrene of the formula

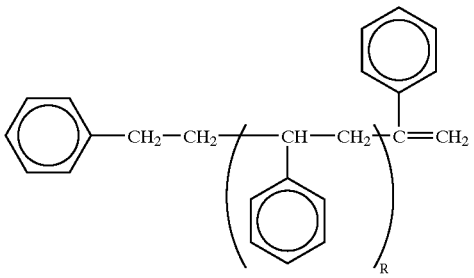

wherein R represents the degree of polymerization.

14. An imaging member in accordance with claim 1 wherein said antiozonant is a carbonate present in an amount of from about 1 to about 15 weight percent.

15. An imaging member in accordance with claim 1 further containing in said charge transport layer a hindered phenol.

16. An imaging member in accordance with claim 15 wherein said hindered phenol is present in said charge transport layer in an amount of from about 1 to about 15 weight percent.

17. An imaging member in accordance with claim 15 wherein said hindered phenol is pentaerythritol tetrakis(3-(3,5-di-tert-butyl-4-hydroxyphenyl)propionate).

18. An imaging member in accordance with claim 1 wherein said charge transport layer contains

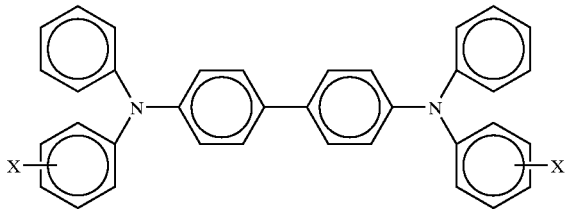

wherein X is alkyl or halo.

19. An imaging member in accordance with claim 1 further comprising an adhesive layer and an overcoat layer.

20. An imaging member in accordance with claim 1 further containing a substrate with a thickness of from about 50 to about 1,000 micrometers.

21. An imaging member in accordance with claim 20 wherein said substrate is in the form of a flexible web, and wherein said substrate possesses a thickness of from about 75 to about 150 micrometers.

22. An imaging member in accordance with claim 1 further containing a charge blocking layer of zinc oxide, titanium oxide, a silane, a silica, polyvinyl butyral, or a phenolic resin.

23. An imaging member in accordance with claim 1 wherein said photogenerating layer comprises metal free phthalocyanines, metal phthalocyanines, vanadyl phthalocyanines, perylenes, titanyl phthalocyanines, hydroxy gallium phthalocyanines, selenium, selenium alloys, or mixtures thereof.

24. An imaging member in accordance with claim 1 wherein said photogenerating layer comprises type V hydroxygallium phthalocyanine.

25. An imaging member in accordance with claim 1 wherein said polymer binder in the charge transport layer is a polycarbonate.

26. An imaging member in accordance with claim 25 wherein said polycarbonate polymer binder is present in an amount of from about 25 to about 90 percent by weight.

27. An imaging member in accordance with claim 1 wherein said member is in the form of a flexible web.

28. An imaging member comprising a photogenerating layer (1) a first charge transport layer in contact with said photogenerating layer and wherein said first charge transport is comprised of a charge transport component, and a resin binder, and thereover and in contact with said first charge transport layer; (2) a plurality of charge transport layers each comprised of a charge transport component, and a resin binder, and wherein said top charge transport layer contains an organic compound additive with a vinyl terminated group or groups having a boiling point of at least about 200° C., and which functions primarily as an antiozonant.

29. An imaging member in accordance with claim 28 wherein said first layer contains from about 35 to about 75 weight percent of said charge transport components, and wherein said vinyl compound is a solid or a liquid.

30. An imaging member comprising a photogenerating layer, and a transport layer comprised of charge transport components, polymer binder and a vinyl containing antiozonant organic compound, and wherein said vinyl compound is a carbonate monomer of diethylene glycol bisallyl carbonate, diethylene glycol bispropylene carbonate, diethylene glycol bisbutylene carbonate, dipropyl glycol bisallyl carbonate dibutyl glycol bisallyl carbonate, bisphenol A bisallyl carbonate, or bisphenol A bisbutylene carbonate.

31. An imaging member in accordance with claim 6 wherein said top layer contains from about 35 to about 50 weight percent of said charge transport component.

32. An imaging member in accordance with claim 14 wherein said carbonate is present in an amount of from about 2 to about 10 weight percent.

33. An imaging member in accordance with claim 16 wherein said phenol is present in the amount of from about 5 to about 10 weight percent.

34. An imaging member in accordance with claim 20 wherein said substrate is in the form of a rigid component, and wherein said substrate possesses a thickness of from about 500 to about 1,000 micrometers.

35. An imaging member comprising a photogenerating layer, and a transport layer comprised of a charge transport component, polymer binder and an antiozonant vinyl containing organic compound, and wherein said vinyl compound is a liquid carbonate monomer with a boiling point of from about 265° C. to about 325° C.

* * * * *